US009354608B2

(12) United States Patent
Donzé

(10) Patent No.: US 9,354,608 B2
(45) Date of Patent: May 31, 2016

(54) BALANCE STOP DEVICE FOR WATCH PIECES WITH TOURBILLON CAGE

(71) Applicant: RICHEMONT INTERNATIONAL SA, Villars-sur-Glane (CH)

(72) Inventor: Edouard Donzé, Les Breuleux (CH)

(73) Assignee: RICHEMONT INTERNATIONAL SA, Villars-sur-Glane (CH)

( * ) Notice: Subject to any disclaimer, the term of this patent is extended or adjusted under 35 U.S.C. 154(b) by 0 days.

(21) Appl. No.: 14/425,245

(22) PCT Filed: Sep. 3, 2013

(86) PCT No.: PCT/EP2013/068141

§ 371 (c)(1),
(2) Date: Mar. 2, 2015

(87) PCT Pub. No.: WO2014/033312

PCT Pub. Date: Mar. 6, 2014

(65) Prior Publication Data

US 2015/0220062 A1 Aug. 6, 2015

(30) Foreign Application Priority Data

Sep. 3, 2012 (EP) ..... 12182743

(51) Int. Cl.
*G04B 17/28* (2006.01)
*G04B 27/02* (2006.01)

(52) U.S. Cl.
CPC ..... *G04B 17/28* (2013.01); *G04B 17/285* (2013.01); *G04B 27/02* (2013.01)

(58) Field of Classification Search
CPC ..... G04B 17/28; G04B 17/285; G04B 27/02
See application file for complete search history.

(56) References Cited

U.S. PATENT DOCUMENTS

2004/0062149 A1 4/2004 Geyer
2006/0013072 A1 1/2006 Golay
2010/0278017 A1* 11/2010 Brossard ..... G04B 17/285 368/130

FOREIGN PATENT DOCUMENTS

EP 1 617 305 A1 1/2006
WO WO 03/048871 A2 6/2003

* cited by examiner

*Primary Examiner* — Amy Cohen Johnson
*Assistant Examiner* — Jason Collins
(74) *Attorney, Agent, or Firm* — Christensen Fonder P.A.

(57) ABSTRACT

A device for stopping a balance of a regulating organ mounted in a tourbillon of a timepiece. The device can be controlled by a setting device of the timepiece. The device includes at least two stop levers which are each secured pivotably to a respective lever pivot axis in such a manner that they can be brought from a rest position, in which the balance and the tourbillon are freely rotatable into a stop position, in which at least one of the stop levers acts via its free end on the balance such that the balance is stopped. The device additionally includes for each of these stop levers pre-loading structure, in such a manner that the force exerted onto the balance by each of the stop levers can act separately. The present invention also relates to a corresponding movement module equipped with such a device, respectively to a corresponding timepiece.

15 Claims, 7 Drawing Sheets

BALANCE STOP DEVICE FOR WATCH PIECES WITH TOURBILLON CAGE

PRIORITY CLAIM

The present application is a National Phase entry of PCT Application No. PCT/EP2013/068141, filed Sep. 3, 2013, which claims priority from European Patent Application Number 12182743.0, filed Sep. 3, 2012, the disclosures of which are hereby incorporated by reference herein in their entirety.

FIELD OF THE INVENTION

The present invention relates to a device for stopping a balance of a regulating organ, said balance being mounted in a tourbillon of a timepiece, wherein the device can be controlled by means of a setting device of the timepiece, as well as to a corresponding movement equipped with such a device, respectively to a timepiece comprising a movement of this type.

BACKGROUND OF THE INVENTION

Mechanical timepieces with complex structure and more elaborated functions, in particular also in terms of driving and regulation of the movement, are popular and are becoming increasingly widespread. Tourbillons are to be regarded in this context as well since being used to make the effect of the force of gravity on the accuracy of the movement of the timepiece independent of the orientation of the timepiece in space by arranging the regulating organ and the escapement of the timepiece on a continuously rotating frame, which is also referred to as a tourbillon. Although this effect needs to be relativized in the case of wristwatches due to the continuous arm movement occurring as the timepiece is worn under normal circumstances, it is indispensable to synchronize the time of mechanical timepieces from time to time with a time indication that is as exact as possible, for example with the aid of a commercially available radio clock controlled by an atomic clock.

However, it is difficult in the case of timepieces having a tourbillon to ensure a precise manual adjustment of the time since the tourbillon, respectively the balance mounted therein has to be stopped. In fact, in such devices all components of the escapement and the balance with the associated balance spring are mounted within the mobile carriage of the tourbillon, which is also referred to as the tourbillon cage. The latter usually consists of what are known as the lower part and upper part, which are connected by a number of columns secured to the outer edge of the cage. The balance located in the rotating tourbillon cage and oscillating therein thus cannot be stopped easily due to the columns of the mobile carriage which are forming an obstacle and are continuously rotating.

On the one hand, this has led to the use in some timepieces of movements having a tourbillon, however entirely without associated stop device for the balance, which in the corresponding timepieces results in the serious disadvantage of a synchronous adjustment of the time that is not accurate to the second. For the sake of completeness, it is noted here that a tourbillon cage or mobile carriage can act as a second hand if the construction has been designed such that the cage rotates once per minute about its own axis. This is, amongst others, the reason why most timepieces with a tourbillon cage visible from the dial side do not require a second hand, wherein however there is the above-mentioned disadvantage that it is not possible, due to the lack of a second hand and therefore the lack of a conventional second stop device, to adjust such tourbillon timepieces in a manner accurate to the second. In addition, it shall also be noted here that a conventional second stop device for second hands known to the person skilled in the art, as described for example in document CH 220 530 (Thommens Uhrenfabriken AG), anyway cannot act as a stop device accurate to the second in timepieces designed in this way with a tourbillon because, as mentioned above, the balance, due to the construction, is arranged almost unattainably within the continuously rotating mobile carriage of the tourbillon.

On the other hand, in view of the above-mentioned disadvantage which considerably compromises the advantage of the increased accuracy of a movement with tourbillon, there have been proposed over time various mechanisms allowing the movement to be stopped in a tourbillon and therefore, in principle, allowing the time to be adjusted in a manner accurate to the second. Examples for this include for example the tourbillon devices described in documents WO2003/048871 (Lange Uhren GmbH), EP 1 617 305 (Montres Breguet SA), CH 699 029 (Fabrique d'horlogerie Minerva SA), and CN101846962 (Tianjin Sea Gull Watch Group Co Ltd).

Without being able to go into extensive detail with regard to these devices, it is noted that the mechanism proposed in document WO2003/048871 (Lange Uhren GmbH) concerns a timepiece having a tourbillon, wherein the timepiece has a stop device which is based substantially on a V- or U-shaped double-arm spring that can be pivoted from a normal position radially outside the orbital path of movement of the columns of the tourbillon cage into a blocking position, in which the free ends of said spring rest against the balance and suppress the movement thereof. This approach based on a double-arm spring requires a lot of space for the pivoting motion of the double-arm spring and is relatively complicated both in terms of the structure and of the operating principle.

The tourbillon according to document EP 1 617 305 (Montres Breguet SA) has a plurality of blocking elements along the tourbillon cage which are controlled from outside the cage and which can stop the balance mounted in the tourbillon cage. However, the tourbillon per se must be changed as a result of this approach by the addition of further components, without any gain in terms of the simplicity and reliability of the mechanism.

Document CH 699 029 (Fabrique d'horlogerie Minerva SA) proposes a tourbillon that no longer requires any columns and therefore no longer has a tourbillon cage in the conventional sense due to the fact that an end of the axis of the balance of said tourbillon is mounted in a stationary bridge of the timepiece. In this device the balance, similarly to a balance in a movement without tourbillon, can therefore be stopped by means of a laterally mounted stop lever. However, this device is suitable only for movements or timepieces in which the conventional tourbillon cage with the characterizing columns thereof can be omitted or should be omitted.

Lastly, document CN 101 846 962 (Tianjin Sea Gull Watch Group Co Ltd) discloses a tourbillon with which the balance mounted in the cage can be stopped by stop pliers acting on the axis of the balance. Due to the short lever arm, however, the stop force exerted on the axis by the stop pliers has to be selected to be very high, wherein it may additionally take a comparatively long time to stop the balance.

SUMMARY OF THE INVENTION

The objective of the present invention is therefore to overcome the above-presented difficulties and disadvantages as well as to create a device for stopping a balance arranged in a tourbillon, which device can be implemented in a space-saving, structurally simple and reliably operating manner. The present invention therefore relates to a device that has the characterising characterizing features specified in claim 1, as well as to a corresponding movement, respectively to a corresponding timepiece which comprise a device of this type.

In order to implement the above-mentioned objectives, the subject matter of the invention is characterized in particular in that the device has at least two stop levers that are each secured pivotably to a respective lever pivot axis in such a manner that they can be brought from a rest position, in which the balance and the tourbillon are freely rotatable, into a stop position, in which at least one of the stop levers acts via its free end on the balance such that said balance is stopped, and in that the device comprises for each of these stop levers pre-loading means in such a manner that the force exerted onto the balance by each of the stop levers can act separately. It can thus be ensured in an advantageous and relatively simple manner, in particular independently of the position of the rotating mobile carriage of the tourbillon, in particular independently of the position in space of the columns of the mobile carriage, that at least one stop lever acts on the balance in the stop position and therefore stops the oscilation thereof, such that the associated timepiece can be adjusted in a manner accurate to the second.

In particular, the pre-loading means of the stop levers consist in each case of a spiral spring arranged on the lever pivot axis of the stop levers, wherein the spring force of the spiral springs arranged on the lever pivot axis of the stop levers is preferably adjustable. The action of the force exerted by each of the stop levers onto the balance is thus ensured separately, and the magnitude of said force additionally can be controlled separately.

Depending on the specific embodiment of the movement, respectively of the timepiece in which the device is to be integrated, there is also the possibility to choose the arrangement of the least two pivotably mounted stop levers either sensibly in a forceps-like manner or sensibly parallel to each other, such that there is a certain flexibility in the implementation of the device.

Furthermore, the device has means for controlling the least two stop the levers which cooperate with the setting device of the timepiece. In particular, said control means may have a slider or a pivot lever that each can be operated by a control lever that can be operated by the setting device of the timepiece, such that various alternatives exist in terms of the control as well.

The invention also relates to a movement module that is suitable for assembly in modular construction with a basic movement and that comprises a device according to the invention for stopping the balance mounted in a tourbillon of a timepiece, wherein the movement module accommodates merely the tourbillon together with the balance, the balance spring for the balance, and the components of the escapement as well as said stop device, and the invention further relates to a timepiece which comprises a basic movement and a movement module with tourbillon and said stop device, the movement module being suitable for assembly with said basic movement. The device according to the invention can therefore be used in a highly versatile and advantageous manner on the whole, primarily when used within a modular construction principle in an associated movement.

BRIEF DESCRIPTION OF THE DRAWINGS

The accompanying drawings illustrate a number of exemplary embodiments of a device according to the present invention.

DETAILED DESCRIPTION

Figure 1A:
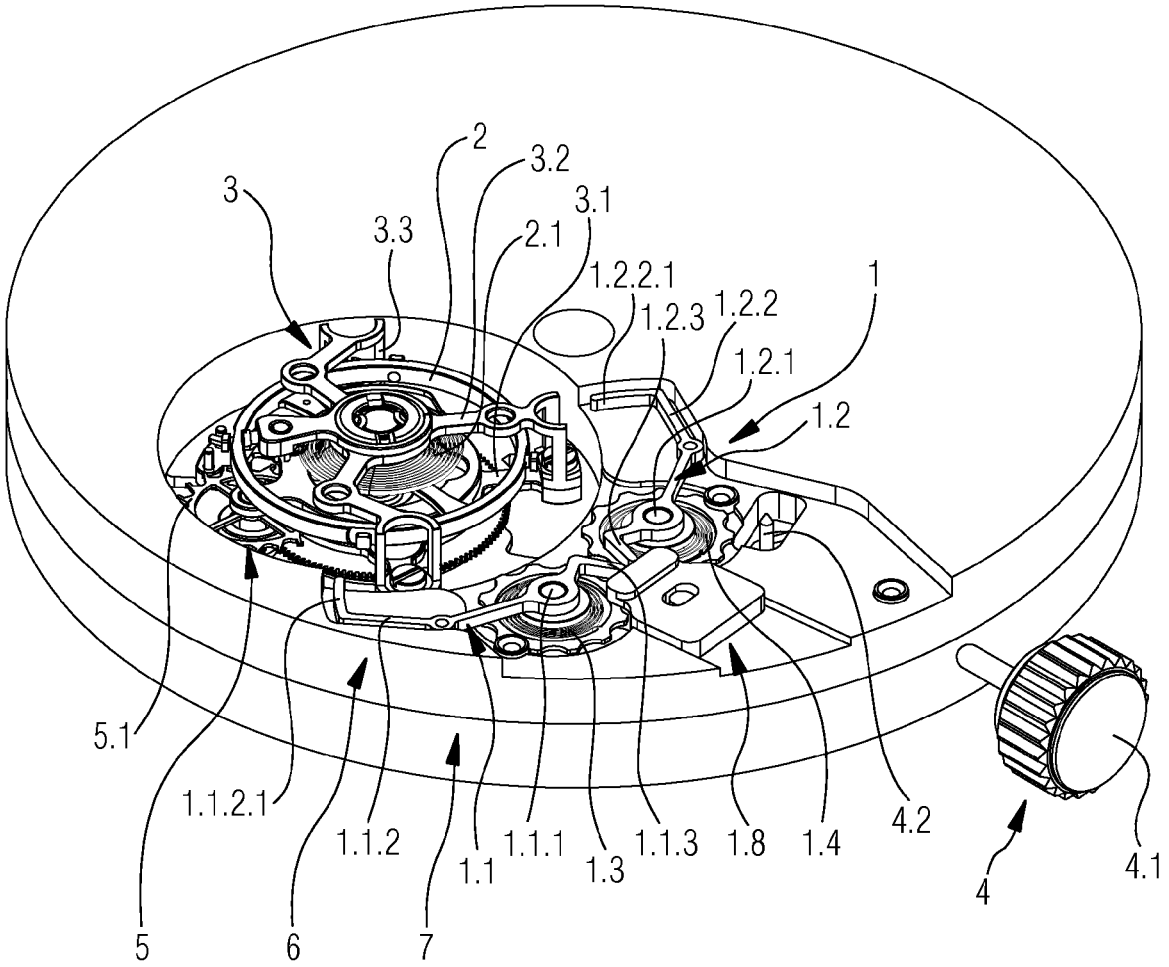
FIG. 1*a* is a perspective view of a movement module built on a basic movement, said movement module comprising a tourbillon with a balance, with an associated balance spring, and with the parts of the escapement, as well as a first embodiment of a device according to the invention for stopping a balance mounted in a tourbillon, wherein the stop levers of the device are in the rest position.

The invention will now be described in detail hereinafter in various embodiments with the aid of the aforementioned drawings.

The device according to the invention for stopping a balance mounted in a tourbillon will be described hereinafter in the state mounted in a movement module and is illustrated accordingly in the drawings, wherein the movement module here is mounted onto a suitable basic movement. Nevertheless, such a device can be used readily in conjunction with any arbitrary tourbillon mounted in a movement. The following description therefore does not in any way limit the field of application of the invention.

Furthermore, the term movement module here is used in the following description such that it refers to a module which is integrated in the case of the timepiece, respectively in the timepiece additionally to the basic movement, wherein the module cooperates functionally with the basic movement of the timepiece. The terms mobile carriage or rotating frame will be used in the following synonymously with the terms tourbillon, respectively tourbillon cage.

FIG. 1*a* is a perspective view of a movement module 7 built on a basic movement 6, said movement module comprising a tourbillon 3, as well as a first embodiment of a device 1 according to the invention for stopping a balance 2 mounted in a tourbillon 3.

The tourbillon 3 per se in principle is already known and can be formed differently in detail. As is usual, it carries a balance 2, a spiral spring 2.1 belonging to the balance 2, and all parts of the escapement 5, such as the escape wheel 5.1 and the pallets, between the tourbillon lower part 3.1, the upper part 3.2 and the columns 3.3 arranged therebetween. Not all of these parts are visible or illustrated in the drawings insofar as these are known in detail to a person skilled in the art as well as are irrelevant in the context of the present invention and therefore will not be described further hereinafter. For this reason the operating principle of a movement with tourbillon also will not be discussed in detail.

Figure 1B:
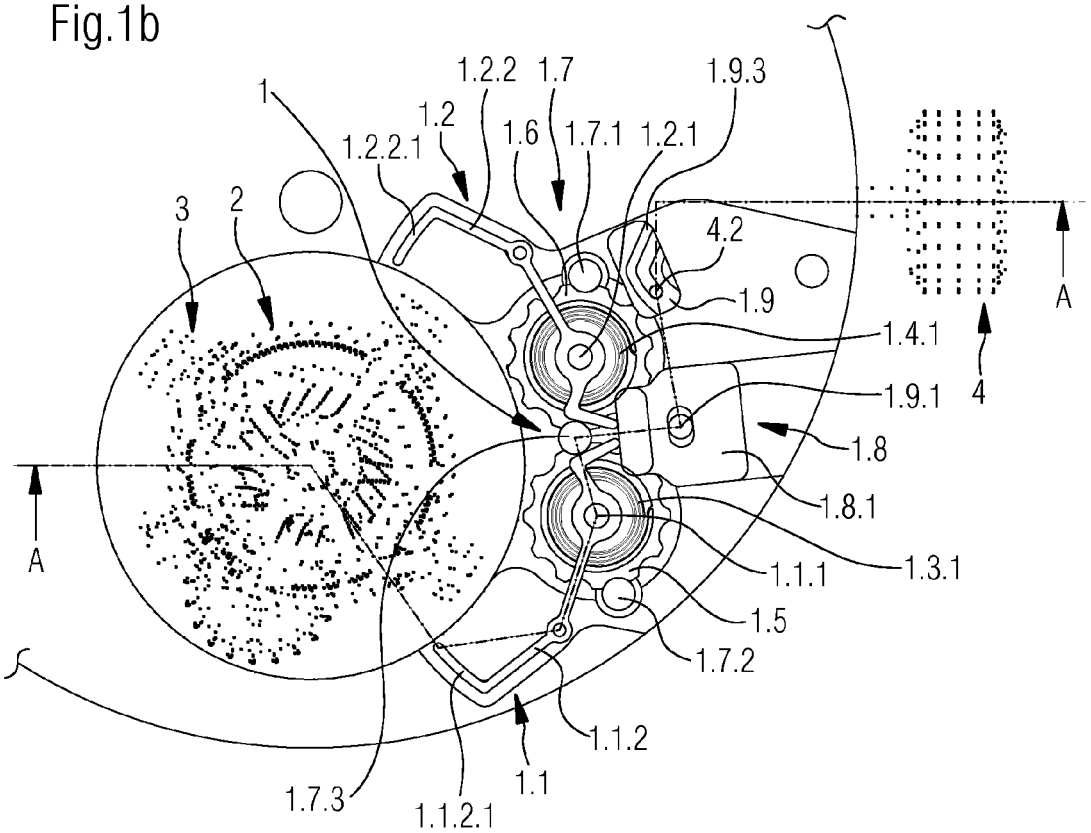
FIG. 1*b* is a plan view of the movement module according to FIG. 1*a*, wherein only the stop device according to the invention is illustrated in detail, whereas the tourbillon already known in principle together with the parts mounted thereon is indicated merely in a dashed manner.
Figure 1C:
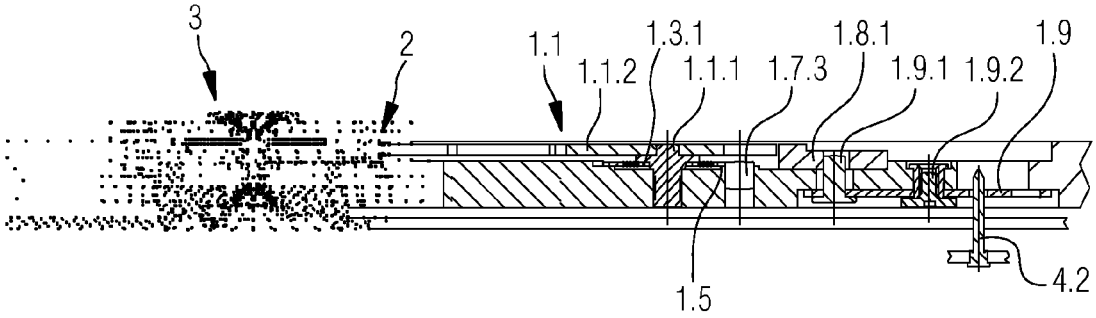
FIG. 1*c* shows a section along the line A-A shown in FIG. 1*b*.

A device 1 according to the invention for stopping a balance 2 mounted in a tourbillon 3 of a timepiece can be controlled by means of a setting device 4 of the timepiece, which is usually provided in the form of a setting crown 4.1 and which will be explained later in greater detail. In order to firstly describe the structure of a device 1 according to the invention, it should be mentioned that such a device 1 has at least two stop levers 1.1, 1.2, which are each secured pivotably to a lever pivot axis 1.1.1, 1.2.1, as can be seen for example from FIG. 1*a*. The at least two stop levers 1.1, 1.2 can therefore be brought from a rest position, in which the balance 2 and the tourbillon 3 are freely rotatable, into a stop position, in which at least one of the stop levers 1.1, 1.2 acts via its free end 1.1.2, 1.2.2 on the balance 2 such that said balance is stopped. In FIG. 1*a* the first stop lever 1.1 and the second stop lever 1.2 of the device 1 are in the rest position. FIG. 1*b* is a plan view of the movement module 7 according to FIG. 1*a*, wherein only the stop device 1 according to the invention is illustrated in detail, whereas the tourbillon 3 already known in principle together with the parts mounted thereon is indicated only in a dashed manner for the aforementioned reasons. FIG. 1*c* shows a section along the line A-A indicated in FIG. 1*b*, wherein the above-mentioned parts of the device 1 are visible in both FIGS. 1*b* and 1*c*.

Figure 1D:
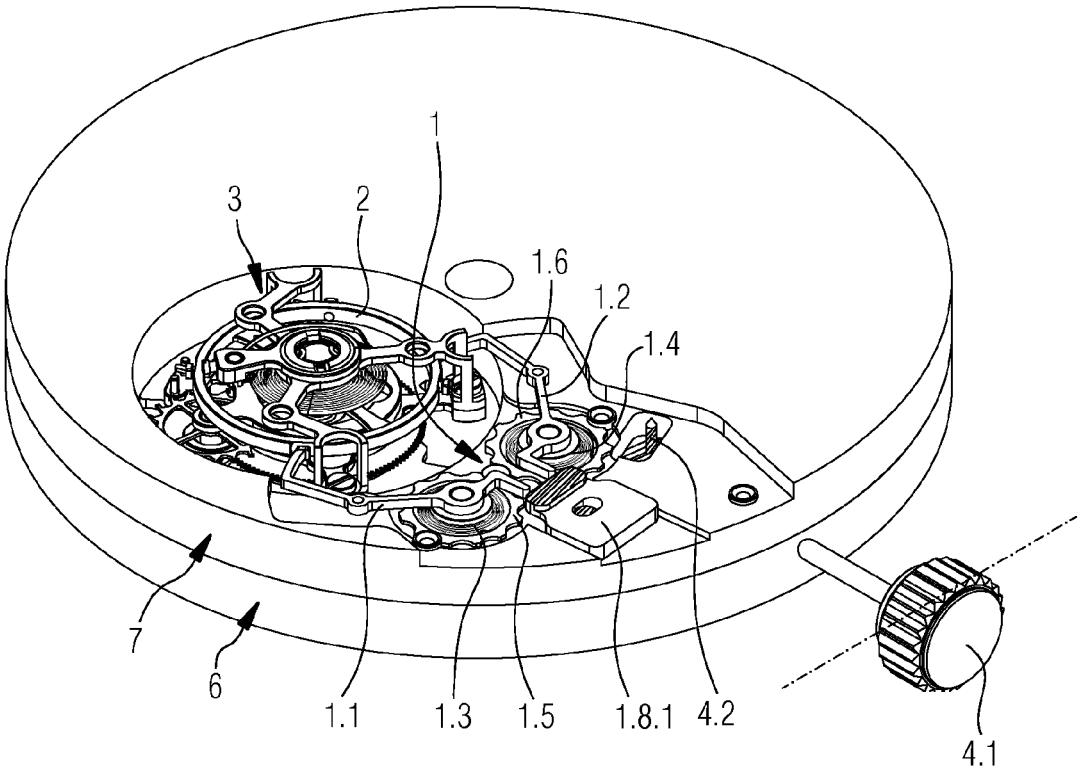
FIG. 1*d* is a perspective view corresponding to FIG. 1*a* of the movement module built on a basic movement, respectively of the first embodiment of a stop device according to the invention, wherein the stop levers of the device are in the stop position.

FIG. 1*d* is a perspective view corresponding to FIG. 1*a* of the movement module 7 built on a basic movement 6, respectively of the first embodiment of a stop device 1 according to the invention, wherein the stop levers 1.1, 1.2 of the device 1 are located in this illustration in the stop position. In this position at least one stop lever 1.1, 1.2 of the device 1, in FIG. 1*d* both stop levers 1.1, 1.2, acts on the circumference of the balance rim of the balance 2 and thus causes the oscillation of the balance 2 to be stopped, respectively fixes said balance.

Figure 1E:
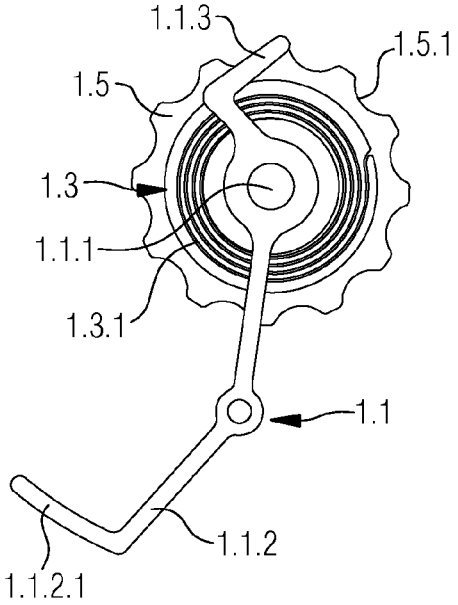
FIGS. 1*e* and 1*f* show enlarged plan views of the first, respectively second stop levers of a stop device according to the invention.
Figure 1F:
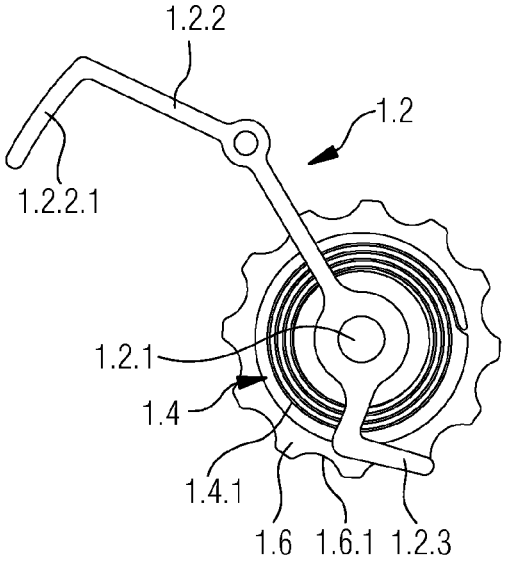

FIGS. 1*e* and 1*f* show enlarged plan views of the first stop lever 1.1, respectively the second stop lever 1.2 of a stop device 1 according to the invention. It can be seen inter alia from these drawings that the device 1 for each of the at least two stop levers 1.1, 1.2 comprises structure, or means, 1.3, 1.4 for pre-loading these stop levers in such a manner that the force exerted onto the balance 2 by each of the stop levers 1.1, 1.2 can act separately. The pre-loading means 1.3, 1.4 of the stop levers 1.1, 1.2 each preferably consist for this purpose of a spiral spring 1.1.3, 1.4.1 arranged on the lever pivot axis 1.1.1, 1.2.1 of the stop levers 1.1, 1.2. Here, the inner winding of the spiral springs 1.3.1, 1.4.1 is secured to a respective lever pivot axis 1.1.1, 1.2.1, whereas the outer winding of the spiral springs 1.3.1, 1.4.1 is each secured to a bridge of the movement module 7, as is clear for example from FIGS. 1*a* and 1*b*.

The spring force of the spiral springs 1.3.1, 1.4.1 arranged on the lever pivot axis 1.1.1, 1.2.1 of the stop levers 1.1, 1.2 is preferably adjustable. The spring force of the spiral springs 1.3.1, 1.4.1 arranged on the lever pivot axis 1.1.1, 1.2.1 of the stop levers 1.1, 1.2 can be adjusted for example by means of retaining rings 1.5, 1.6 secured to the outer ends of the spiral springs 1.3.1, 1.4.1, said retaining rings being visible inter alia in FIGS. 1*e*, 1*f* and 1*b*. The retaining rings 1.5, 1.6, in order to easily perform the adjustment of the spring force of the spiral springs 1.3.1, 1.4.1, have notches 1.5.1, 1.6.1 that can cooperate with corresponding control pins 1.7.1, 1.7.2, 1.7.3 arranged on said bridge of the movement module 7, such that in this case the outer winding of the spiral springs 1.3.1, 1.4.1 is secured to the bridge of the movement module 7 via the retaining rings 1.5, 1.6 and the control pins 1.7.1, 1.7.2, 1.7.3. In order to adjust the spring force of the spiral springs 1.3.1, 1.4.1 as desired, a detachment of the corresponding retaining ring 1.5, 1.6 from the control pins 1.7.1, 1.7.2, 1.7.3, a rotation of the ring 1.5, 1.6 through an angle corresponding to the desired new spring force, as well as a renewed securing of the retaining ring 1.5, 1.6 between the control pins 1.7.1, 1.7.2, 1.7.3 is therefore sufficient.

FIGS. 1*a* and 1*d* also show that, according to the first embodiment of a device 1 according to the invention, the at least two pivotably mounted stop levers 1.1, 1.2 are arranged sensibly in a forceps-like manner relative to each other. These can thus contact, respectively act on the balance 2, respectively on the tourbillon 3 at least at two sensibly opposite positions and can thus stop the balance 2 in the stop position of the levers 1.1, 1.2. In the preferred embodiment of the device 1 reproduced in the drawings the free ends 1.1.2, 1.2.2 of the stop levers 1.1, 1.2, of which at least one acts on the balance 2 in the stop position of the stop levers 1.1, 1.2 such that said balance is stopped, are formed sensibly in an elbow-shaped manner. As can be seen for example from FIGS. 1*d*, 1*e* and 1*f*, in particular the end pieces 1.1.2.1, 1.2.2.1 of said free ends 1.1.2, 1.2.2 of the stop levers 1.1, 1.2 are arranged at the free ends 1.1.2, 1.2.2 of the stop levers 1.1, 1.2 in such a manner that they are approximately perpendicular to the circumference of the balance rim of the balance 2 in the stop position of the stop levers 1.1, 1.2, so as to make it possible for the balance 2 to be acted on even in the immediate vicinity of a column 3.3 of the tourbillon 3.

Furthermore, a device 1 according to the invention for stopping a balance 2 mounted in a tourbillon 3 of a timepiece comprises structure, or means, for controlling 1.8, 1.9 the at least two stop levers 1.1, 1.2, which cooperate with the above-mentioned setting device 4 of the timepiece. The setting device usually consists of a setting crown 4.1 that can adopt a rest position as well as at least one pulled position, in which for example the time and/or the date can be set and also further functions of the timepiece can be operated. The device 1 according to the invention cooperates with a previously known setting device 4, respectively setting crown 4.1 of this type in such a manner that the at least two stop levers 1.1, 1.2, in the rest position of the setting device 4, are in their rest position, in which the balance 2 and the tourbillon 3 are freely rotatable, whereas the at least two stop levers 1.1, 1.2, in at least one position, specifically in the position of the setting crown for adjusting the time, or in all other positions of the setting device 4, are in their stop position, in which at least one of the stop levers 1.1, 1.2 via its free end 1.1.2, 1.2.2 acts on the balance 2 such that it is stopped.

In the first embodiment of a device 1 according to the invention illustrated in FIGS. 1*a* to 1*d* the means for controlling 1.8, 1.9 the at least two stop levers 1.1, 1.2 have a slider 1.8.1 and a control lever 1.9 for this purpose. The slider 1.8.1 engages with the control lever 1.9 by means of a setting pin 1.9.1 mounted on an end of the control lever 1.9, whereas the latter, as can be seen from FIG. 1*c*, is arranged pivotably about an axis 1.9.2 and can be operated by the setting device 4 of the timepiece. This is implemented, as is usual, by means of the pin 4.2 operated by the setting shaft which is not illustrated, said pin engaging with an L-shaped aperture 1.9.3 mounted at the other end of the control lever 1.9, as can be seen for example from FIGS. 1*b* and 1*d*. The slider 1.8.1 has an elongate opening, with which said setting pin 1.9.1 of the control lever 1.9 engages, and is mounted so as to slide in a groove in the supporting bridge of the movement module 7. A further bridge 7.1 of the movement module 7, which is mounted onto said supporting bridge of the movement module 7 and holds the device 1 from above, has been omitted in the drawings, apart from in FIG. 2*c*, for ease of understanding. The end of the slider 1.8.1 facing toward the at least two stop levers 1.1, 1.2 acts on the end regions 1.1.3, 1.2.3 of the at least two stop levers 1.1, 1.2 facing toward the slider 1.8.1, in such a manner that the at least two stop levers 1.1, 1.2 are held in the rest position depending on the position of the setting device 4 of the timepiece or are released and can swing into the stop position under the influence of the pre-load exerted by the spiral springs 1.3, 1.4.

Figure 2A:
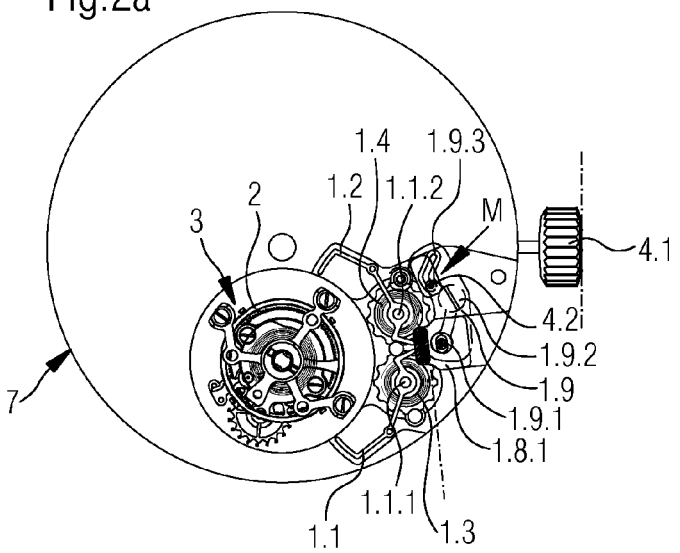
FIGS. 2*a*, 2*b* and 2*c* schematically illustrate, by means of plan views corresponding to FIG. 1*b*, the operating principle of the first embodiment of a device according to the invention for stopping a balance mounted in a tourbillon, said balance being integrated in a movement module, wherein the device is illustrated in FIG. 2*a* in the rest position and is illustrated in FIGS. 2*b* and 2*c* in two different stop positions.
Figure 2B:
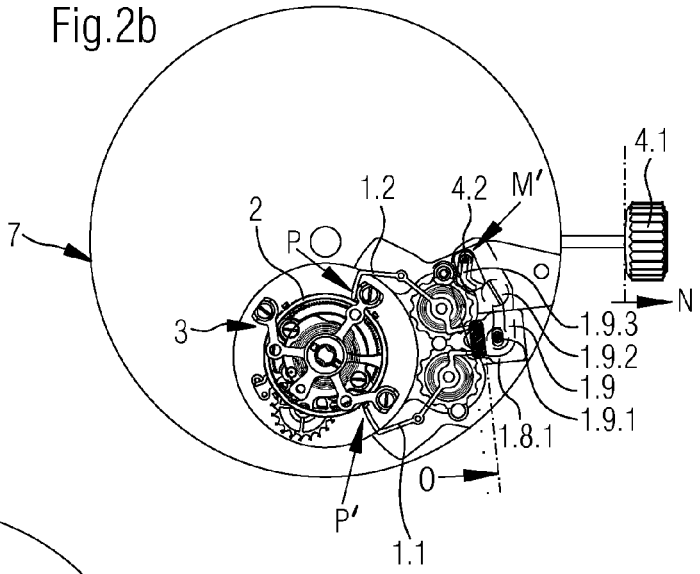
Figure 2C:
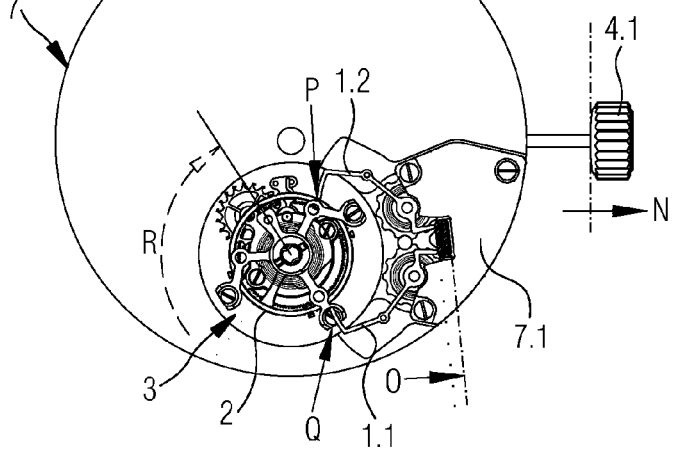

The operating principle already indicated briefly above of the first embodiment of a device 1 according to the invention for stopping a balance mounted in a tourbillon will now be presented in greater detail by means of FIGS. 2*a*, 2*b* and 2*c*, which show plan views corresponding to FIG. 1*b* of the device 1 integrated in a movement module 7.

FIG. 2*a* shows the device 1 in its rest position, in which the setting crown 4.1 of the timepiece is likewise in its rest position and the pin 4.2, denoted in FIG. 2*a* by an arrow M, engages at one end of the L-shaped aperture 1.9.3 of the control lever 1.9. The slider 1.8.1 is thus held in its rest position by the engagement of the setting pin 1.9.1 of the control lever 1.9 with the elongate opening of the slider 1.8.1, in which rest position the end of the slider 1.8.1 facing toward the at least two stop levers 1.1, 1.2 acts on the end regions 1.1.3, 1.2.3 facing toward the slider 1.8.1 of the at least two stop levers 1.1, 1.2 pre-loaded by the spiral springs 1.3, 1.4, in such a manner that the at least two stop levers 1.1, 1.2 are held in their rest position.

If the setting crown 4.1 is now brought into a pulled position by the user of the timepiece, in particular into the position denoted in FIG. 2*b* by an arrow N in order to adjust the time, the pin 4.2 is thus moved at the other end of the L-shaped aperture 1.9.3 of the control lever 1.9—likewise denoted by an arrow M' in FIG. 2*b*—and the control lever 1.9 is thus pivoted. This pivoting motion, due to the engagement of the setting pin 1.9.1 of the control lever 1.9 with the elongate opening of the slider 1.8.1, causes said slider to slide into its position of deflection, in which the end of the slider 1.8.1 facing toward the at least two stop levers 1.1, 1.2 releases the end regions 1.1.3, 1.2.3 of the at least two stop levers 1.1, 1.2 facing toward the slider 1.8.1 such that these can swing under the action of the pre-load of the spiral springs 1.3, 1.4 into the stop position denoted in FIG. 2*b* by an arrow O. As can be seen in FIG. 2*b*, in the position in space of the tourbillon 3 illustrated there by way of example, all end pieces 1.1.2.1, 1.2.2.1 of said free ends 1.1.2, 1.2.2 of the stop levers 1.1, 1.2 contact in this stop position of the stop levers 1.1, 1.2 the circumference of the balance rim of the balance 2, which is illustrated symbolically in FIG. 2*b* by means of arrows P and P'. Due to the resulting locking of the balance 2, respectively of the tourbillon 3, the user can in this pulled position of the setting crown 4.1 adjust the timepiece in a manner accurate to the second.

FIG. 2*c* shows the device 1 in a further stop position, which is due to a different rotated position in space of the tourbillon 3 as compared to the position according to FIG. 2*b*, this different rotated position being indicated symbolically in FIG. 2*c* by means of an arrow R. In the position in space of the tourbillon 3 illustrated there by way of example, only one of the end pieces 1.1.2.1, 1.2.2.1 of said free ends 1.1.2, 1.2.2 of the stop levers 1.1, 1.2 can contact in the stop position of the stop levers 1.1, 1.2 the circumference of the balance rim of the balance 2, as denoted by means of an arrow P, and thus fix the balance 2, respectively the tourbillon 3, whereas the other of the end pieces 1.1.2.1, 1.2.2.1 of said free ends 1.1.2, 1.2.2 of the stop levers 1.1, 1.2 contacts one of the columns 3.3 of the tourbillon 3, which is indicated by means of an arrow Q. Depending on the specific embodiment of the columns 3.3 and depending on the position in space of the tourbillon 3, it is also possible that one of the free ends 1.1.2, 1.2.2 can contact the circumference of the balance rim of the balance 2 through an opening or an aperture in the columns 3.3. However, insofar as the device 1 has at least two stop levers 1.1, 1.2 and also due to the corresponding geometric arrangement thereof relative to the tourbillon 3, it is ensured in any position in space of the tourbillon 3 that the balance 2, respectively the tourbillon 3, in the stop position of the stop levers 1.1, 1.2 is fixed by at least one of these stop levers 1.1, 1.2. Insofar as at least one of the free ends 1.1.2, 1.2.2 of the stop levers 1.1, 1.2 thus acts on the circumference of the balance rim of the balance 2 in any position of the tourbillon 3, with the result that the tourbillon 3 is held in the rest position, the adjustment of the timepiece can thus be ensured in a manner accurate to the second by its wearer. FIG. 2*c* additionally illustrates the above-mentioned further bridge 7.1 mounted on the movement bridge of the movement module 7 and used as a securing element for the parts of the device 1, insofar as all other parts of the device 1 covered in part by this bridge are arranged as in FIG. 2*b*.

Due to the above-described operating principle of the device as well as due to the geometric arrangement presented beforehand of the at least two stop levers 1.1, 1.2 relative to the tourbillon 3, it is clear that the force exerted onto the circumference of the balance rim of the balance 2 by the end pieces 1.1.2.1, 1.2.2.1 of the free ends 1.1.2, 1.2.2 of the stop levers 1.2, 1.2 in their stop position can be adjusted by the horologist with the aid of the spiral springs 1.3.1, 1.4.1, the retaining rings 1.5, 1.6 and the control pins 1.7.1, 1.7.2, 1.7.3 such that on the one hand a sliding of the oscillating balance 2 from the start of the push action thereupon to its complete standstill is reduced to a minimum, such that the latter is still stopped before the next second. On the other hand the force exerted by said end pieces 1.1.2.1, 1.2.2.1 of the free ends 1.1.2, 1.2.2 of the stop levers 1.2, 1.2 is adjusted such that it indeed reliably stops the freely oscillating balance 2, but does not act in a disadvantageous manner on the delicate components of the tourbillon 3, for example due to selection of an excessively high force. For this reason, the embodiment of the device according to the invention which allows an adjustment of the force exerted by the stop levers 1.2, 1.2 even after its installation is preferred.

Figure 3A:
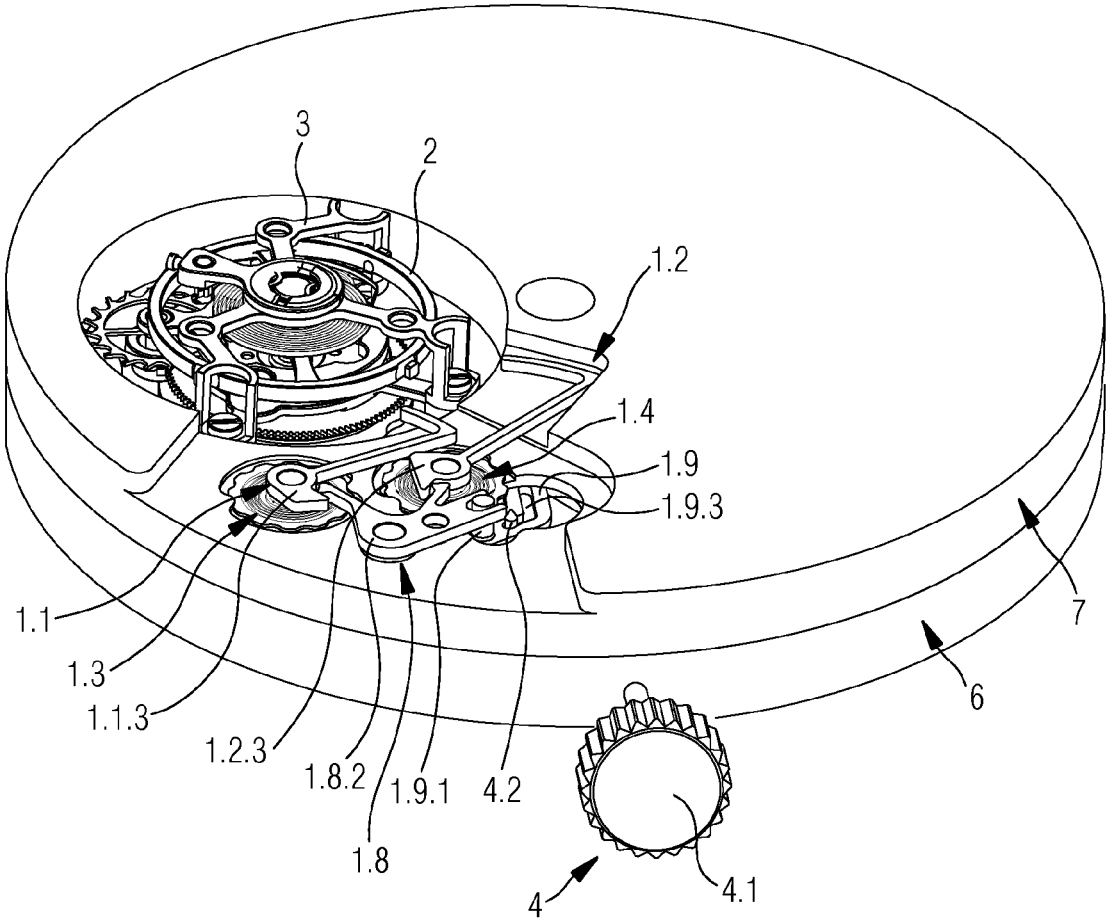
FIGS. 3*a*, 3*b* and 3*c* schematically and by way of example illustrate, by means of illustrations analogous to FIGS. 1*a*, 1*b* and 1*c*, a second embodiment of a device according to the invention, in which the stop levers are arranged sensibly parallel, instead of sensibly in a forceps-like manner as in the first embodiment of a stop device according to the invention.
Figure 3B:
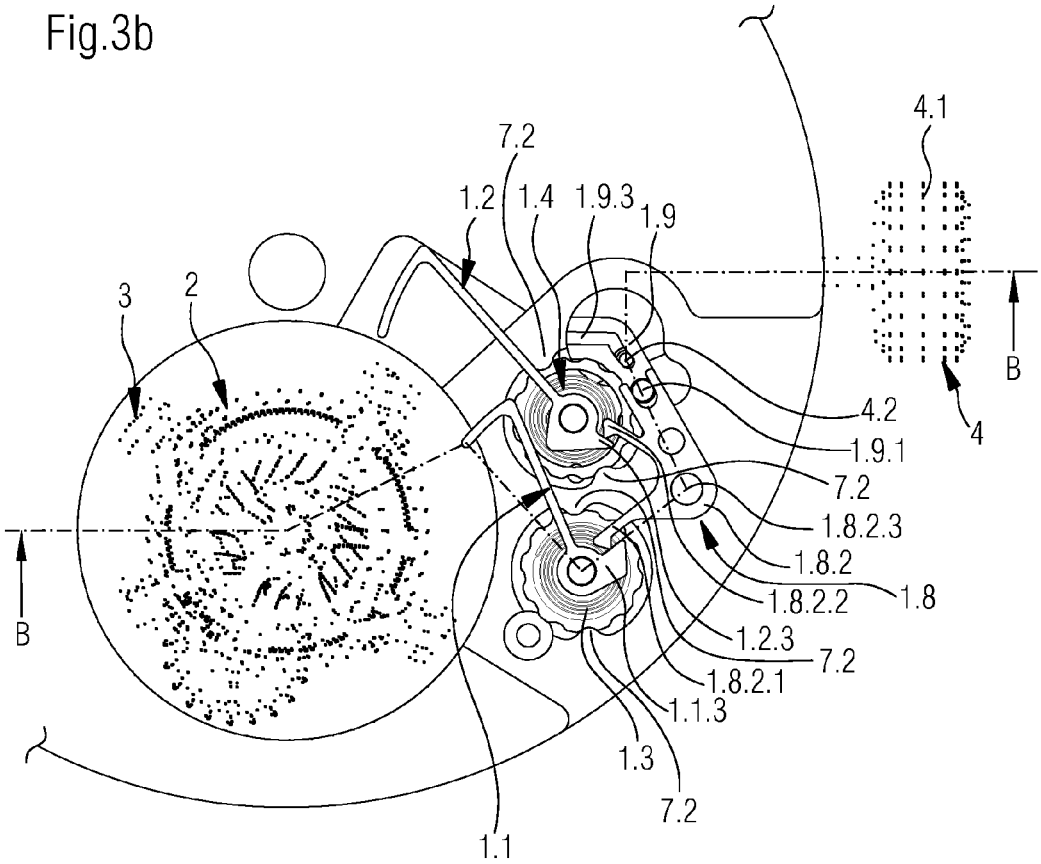
Figure 3C:
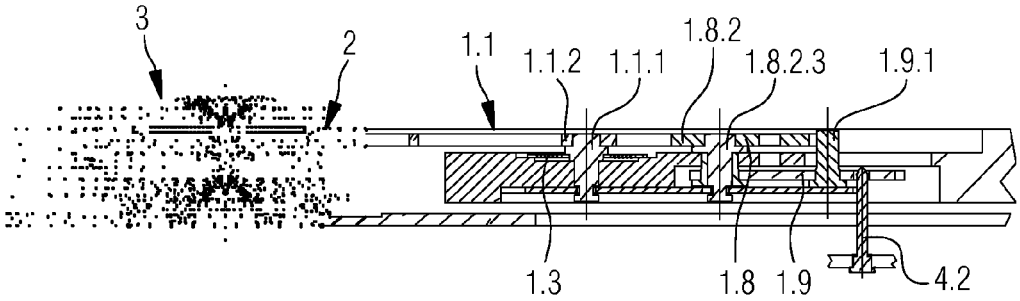

By means of illustrations analogous to FIGS. 1 *a*, 1*b*, and 1*c*, FIGS. 3*a*, 3*b*, and 3*c* illustrate by way of example and schematically a second embodiment of a device 1 according to the invention, in which the stop levers 1.1, 1.2 are arranged sensibly parallel to one another instead of sensibly in a forceps-like manner as in the first embodiment of a stop device 1 according to the invention. Due to this sensibly parallel arrangement of the least two pivotably mounted stop levers 1.1, 1.2 relative to one another, the levers 1.1, 1.2 contact the balance 2, respectively the tourbillon 3 in the stop position at least at two points arranged sensibly adjacently. This may be advantageous depending on the arrangement of the movement or of the timepiece in which the device 1 is to be integrated and is an alternative to the arrangement according to the first embodiment.

Furthermore, the means for controlling 1.8, 1.9 the least two stop levers 1.1, 1.2 are also formed slightly differently in the second embodiment of a stop device 1 according to the invention illustrated in FIGS. 3*a*, 3*b*, 3*c* insofar as these have a pivot lever 1.8.2 in addition to the control lever 1.9. The control lever 1.9, completely analogously to what was mentioned above, cooperates with the setting device 4 of the timepiece and can be operated thereby as in the first embodiment in a manner already known. Analogously to the first embodiment of the device 1, the pivot lever 1.8.2 also cooperates with the control lever 1.9 by means of a setting pin 1.9.1, which engages with a corresponding groove in the pivot lever 1.8.2. As is clear for example from FIG. 3*b*, the at least two stop levers 1.1, 1.2 are lastly acted on by the respective cooperation between the end regions 1.1.3, 1.2.3 of the stop levers 1.1, 1.2 facing toward the pivot lever 1.8.2 and associated arms 1.8.2.1, 1.8.2.2 of the pivot lever 1.8.2, in such a manner that the at least two stop levers 1.1, 1.2, depending on the position of the setting device 4 of the timepiece, are either held in the rest position or are released and can swing into the stop position under the influence of the pre-load exerted by the spiral springs 1.3, 1.4. In addition, in the second embodiment the retaining pins 1.7.1, 1.7.2, 1.7.3 of the first embodiment for the adjustment of the position of the retaining rings 1.5, 1.6 have been replaced by indentations 7.2 which are integrated directly into the bridge of the movement module 7 and which cooperate analogously with the notches 1.5.1, 1.6.1 on the retaining rings 1.5, 1.6 and, similarly to said control pins, perform the function of retaining elements.

Analogously to FIGS. 2*a* and 2*b*, FIGS. 4*a* and 4*b* by means of plan views schematically show the operating principle of the second embodiment of a device 1 according to the invention for stopping a balance 2 mounted in a tourbillon 3. The device 1 integrated in a movement module 7 is again illustrated in its rest position in FIG. 4*a*, in which the setting crown 4.1 of the timepiece is also illustrated in its rest position. The balance 2 and the tourbillon 3 are freely rotatable in this position.

Figure 4A:
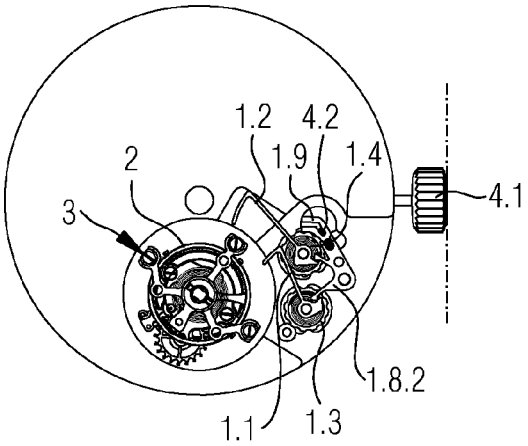
FIGS. 4*a* and 4*b* schematically illustrate, by means of plan views, the operating principle of the second embodiment of a device according to the invention for stopping a balance mounted in a tourbillon, said balance being integrated in a movement module, wherein the device is illustrated in FIG. 4*a* in the rest position and is illustrated in FIG. 4*b* in a stop position selected by way of example.
Figure 4B:
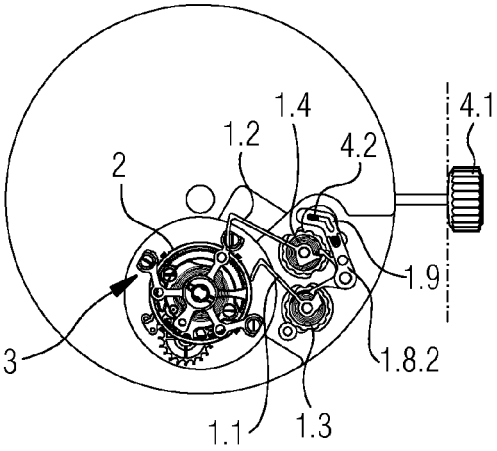

By pulling the setting crown 4.1 into one of the pulled positions thereof, in particular into the position for adjusting the time of the timepiece, the control lever 1.9, similarly to the first embodiment of the device 1, is pivoted by means of the engagement of the pin 4.2, which in turn leads to a pivoting motion of the pivot lever 1.8.2. This causes the release of the stop levers 1.1, 1.2, which swing into their stop position under the influence of the pre-load exerted by the spiral springs 1.3, 1.4. In FIG. 4*b*, the device 1 is illustrated in a stop position selected by way of example, in which one of the at least two stop levers 1.1, 1.2 contacts the circumference of the balance 2 and the other of the at least two stop levers 1.1, 1.2 contacts a column of the tourbillon 3. In this embodiment it is thus also ensured in any position in space of the tourbillon 3 that the balance 2, respectively the tourbillon 3 is locked in the stop position of the at least two stop levers 1.1, 1.2 in order to allow the time to be adjusted in a manner accurate to the second.

It is of course possible in the two above-described embodiments of the device 1 to swap the corresponding means for controlling 1.8, 1.9 the at least two stop levers 1.1, 1.2, for example to control the stop levers 1.1, 1.2 which are mounted in a forceps-like manner relative to each other by means of a pivot lever 1.8.2. Other equivalent means can also be used for this purpose. As a further alternative it is also possible to provide more than two stop levers 1.1, 1.2, for example insofar as this may be necessary due to the specific embodiment of the tourbillon 3 with which the device 1 is to cooperate. In this case it is sufficient to arrange further stop levers appropriately around the balance 2. respectively the tourbillon 3, as well as to modify the slider 1.8.1 and/or the pivot lever 1.8.2 in such a manner, for example by enlarging the end face thereof or by adding appropriate arms, that said slider or pivot lever can cooperate with all end regions 1.13, 1.2.3 of the stop levers 1.1, 1.2 facing toward said slider or pivot lever.

Figure 5A:
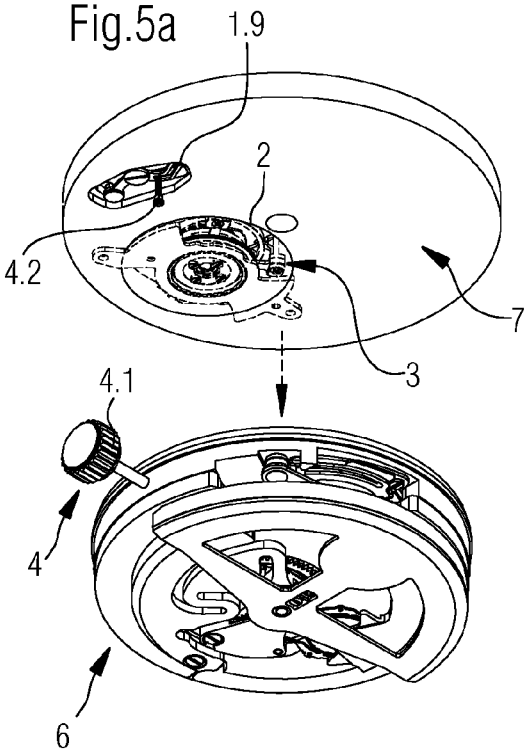
FIG. 5*a* illustrates, in an exploded illustration, the assembly of a movement module, comprising a device according to the invention for stopping a balance mounted in a tourbillon, with a basic movement, whereas FIG. 5*b* schematically and by way of example illustrates a perspective view, as seen from the movement side, of a basic movement suitable for this assembly, in which in particular parts of the setting device of the timepiece cooperating with the device according to the invention can be seen.
Figure 5B:
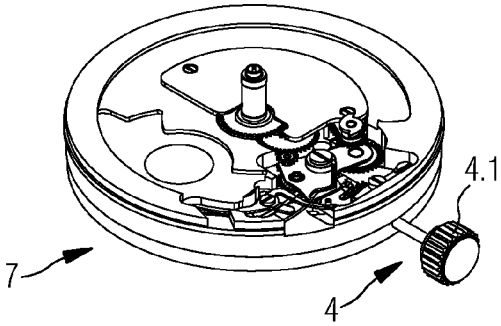

It is also particularly advantageous for the device 1 according to the invention for stopping a balance 2 mounted in a tourbillon 3 to be integrated in a movement module 7 that is suitable for assembly in modular design with a basic movement. Besides the device 1 for stopping the balance 2 mounted in a tourbillon 3 of a timepiece, a movement module 7 of this type preferably comprises merely the tourbillon 3 together with the balance 2, the balance spring for the balance, as well as the components of the escapement. However, further movement functions or functions of the timepiece can also be accommodated. In the aforementioned case, however, this allows an extremely modular design insofar as a placement of a movement module 7 of this type with balance 2, tourbillon 3 and a device 1 according to the invention on a suitable basic movement transforms the latter into a movement with tourbillon function due to a simple production step. FIG. 5*a* illustrates this schematically by means of an exploded illustration illustrating the assembly of a movement module 7, comprising a device 1 according to the invention for stopping a balance 2 mounted in a tourbillon 3, with a basic movement 6. FIG. 5*b* by way of example and schematically illustrates a perspective view of a basic movement 6 suitable for this assembly, in which in particular parts of the setting device 4 of the timepiece cooperating with the device according to the invention are visible. However, insofar as this is known to the person skilled in the art, there is no need to discuss in further detail the parts of such basic movements.

The present invention therefore is not only directed to a device 1 for stopping the balance 2 mounted in a tourbillon 3 of a timepiece and to a movement comprising this device 1, in particular a movement module 7 manufactured in a modular manner, but also to a timepiece that comprises such a device 1, respectively such a movement module 7. A timepiece of this type thus preferably comprises a first movement module in the form of a basic movement module 6 that accommodates the energy source of the movement, the geartrain as well as said setting device 4 of the timepiece, and also a second movement module in the form of the movement module 7 according to the invention that accommodates the tourbillon 3 together with the balance 2, the balance spring 2.1 for the balance as well as the components of the escapement.

As is clear from the description above of the structure and operating principle of the device 1, one of the essential aspects of the invention lies in the provision of at least two stop levers arranged in a forceps-like manner relative to each other or parallel to each other that each have dedicated pre-loading means. This allows to stop the balance in a tourbillon in any of its possible positions in space in a relatively simple and space-saving manner. In addition, the pre-loading means can consist preferably of spiral springs of which the pre-load is adjustable. A reliable and interference-free control of the device can be ensured by a slider that is mounted slidingly or by a pivot lever, wherein both solutions are also simple and space-saving. The combination of the proposed alternatives allows an adaptation of the device to the specific conditions encountered with integration in a predefined tourbillon, respectively in a given timepiece. By use of modular design, the invention additionally allows a relatively simple and cost-effective production of timepieces with tourbillon and also consequently easier maintenance of the system. Due to the modular design, the proposed device does not require any significant changes with respect to the basic movement, and therefore the system according to the invention also has the advantage that it can be used directly with such basic movements.

The invention claimed is:

1. A device for stopping a balance mounted in a tourbillon of a timepiece, wherein the device can be controlled by a setting device of the timepiece, wherein the device comprises at least two stop levers which are each pivotably attached to a respective lever pivot axis and which are not mounted on the tourbillon, the at least two stop levers pivotably attached in such a manner that the two stop levers can be brought from a rest position, in which the balance and the tourbillon are freely rotatable into a stop position, in which a free end of at least one of the stop levers acts on the balance such that said balance is stopped, wherein the device comprises for each of the stop levers pre-loading structure, in such a manner that the force exerted onto the balance by each of the stop levers can act separately.

2. The device according to claim 1, wherein each of the pre-loading structures of the stop levers consists of a spiral spring arranged on the lever pivot axis of the stop levers.

3. The device according to claim 2, wherein the spring force of the spiral springs arranged on the lever pivot axis of the stop levers is adjustable.

4. The device according to claim 3, wherein the spring force of the spiral springs arranged on the lever pivot axis of the stop levers is adjusted by means of retaining rings secured to the outer ends of the spiral springs, wherein the retaining rings have notches which can cooperate with corresponding retaining elements arranged on a bridge of the timepiece.

5. The device according to claim 1, wherein the at least two pivotably mounted stop levers are positioned relative to each other in a u-shaped manner, in such a manner that the stop levers can touch the balance, respectively the tourbillon in at least two places which are opposite to each other.

6. The device according to claim 1, wherein the at least two pivotably mounted stop levers are positioned parallel to each other, in such a manner that they can touch the balance, respectively the tourbillon in at least two places which are next to each other.

7. The device according to claim 1, wherein the free ends of the stop levers, of which at least one acts on the balance in the stop position of the stop levers in such a manner that said balance is stopped, are elbow-shaped, in such a manner that in the stop position the end pieces of said free ends of the stop levers are approximately perpendicular to the circumference of the balance rim of the balance, in order to allow the balance to be acted on also in the immediate vicinity of a column of the tourbillon.

8. The device according to claim 1, wherein the device further comprises structure for controlling the at least two stop levers which cooperate with the setting device of the timepiece in such a manner that, in a rest position of the setting device, the at least two stop levers are located in their rest position, in which the balance and the tourbillon are freely rotatable, and, in at least one or all other positions of the setting device, the at least two stop levers are located in their stop position, in which at least one of the stop levers acts on the balance with its free end in such a manner that said balance is stopped.

9. The device according to claim 8, wherein the structure controlling the at least two stop levers comprise a slider and a control lever, wherein the slider, by means of a control pin, is in cooperation with the control lever which can be operated by the setting device of the timepiece.

10. The device according to claim 9, wherein the slider has an elongate opening, in which the control pin of the control lever engages, and is mounted slidingly in a bridge of the timepiece, wherein the end of the slider facing toward the at least two stop levers acts on the end regions of the at least two stop levers facing toward the slider, in such a manner that the at least two stop levers, depending on the position of the setting device of the timepiece, are either held in the rest position or are released and can swing into the stop position.

11. The device according to claim 8, wherein the structure controlling the at least two stop levers comprise a pivot lever and a control lever, wherein the pivot lever, by means of a setting pin, is in cooperation with the control lever which can be operated by the setting device of the timepiece.

12. A movement, wherein the movement comprises the device according to claim 1.

13. The movement according to claim 12, wherein the movement is designed as a movement module in a modular construction and is suitable for assembly with a basic movement, the movement module comprising only the tourbillon together with the balance, the balance spring for the balance, and the components of the escapement, and wherein the movement module is positioned beside the device for stopping the balance mounted in a tourbillon of a timepiece.

14. A timepiece, in particular a wristwatch, wherein the timepiece comprises the device according to claim 1.

15. The timepiece according to claim 14, wherein the timepiece comprises a first movement module in the form of a basic movement module which accommodates an energy source of the movement, the geartrain, and said setting device of the timepiece, as well as a second movement module in a form of a movement module which accommodates the tourbillon together with the balance, the balance spring for the balance, and the components of the escapement, and wherein the movement is designed as a movement module in a modular construction and is suitable for assembly with a basic movement, the movement module comprising only the tourbillon together with the balance, the balance spring for the balance, and the components of the escapement, and wherein the movement module is positioned beside the device for stopping the balance mounted in a tourbillon of a timepiece.

* * * * *